United States Patent [19]

Rosofsky

[11] Patent Number: 4,486,109

[45] Date of Patent: Dec. 4, 1984

[54] TOOTHBRUSH ASSEMBLY COMBINING REPLACEABLE BRUSH ASSEMBLY WITH MASSAGING DEVICE

[75] Inventor: Paul M. Rosofsky, Willingboro, N.J.

[73] Assignee: Oral Ease Inc., Willingboro, N.J.

[21] Appl. No.: 350,198

[22] Filed: Feb. 19, 1982

[51] Int. Cl.[3] ..... A47L 1/08; A47L 13/12

[52] U.S. Cl. ..... 401/24; 401/37; 401/39; 401/132; 401/195; 401/196; 604/3; 128/62 A; 15/110; 15/176

[58] Field of Search ..... 15/110, 106, 104.93, 15/104.94, 176, 167 R; 128/62 A; 401/132, 133, 134, 24, 37, 39, 195, 196; 604/1, 2, 3, 200, 306

[56] References Cited

U.S. PATENT DOCUMENTS

| | | | |
|---|---|---|---|
| 1,660,095 | 2/1928 | Schiele | 128/62 A |
| 1,680,558 | 8/1928 | Loiselle | 15/176 X |
| 1,897,365 | 2/1933 | Duey | 15/176 |
| 1,901,230 | 3/1933 | Duey | 15/167 R |
| 2,005,337 | 6/1935 | Doll . | |
| 2,079,728 | 5/1937 | Arnold | 128/62 A |
| 2,083,595 | 6/1937 | Clarren | 128/62 A |
| 2,090,144 | 8/1937 | Palimeri et al. | 15/176 |
| 2,153,554 | 4/1939 | Fitzgerald . | |
| 2,155,245 | 4/1939 | Sekine . | |
| 2,251,853 | 8/1941 | Pandiyan | 15/176 |
| 2,511,235 | 6/1950 | Arwood . | |
| 2,558,332 | 6/1951 | Artale . | |
| 2,651,068 | 9/1953 | Seko . | |
| 2,845,649 | 8/1958 | Hutson . | |
| 3,321,796 | 5/1967 | Lelicoff | 15/167 R |
| 3,324,855 | 6/1967 | Heimlich | 604/3 |
| 4,150,457 | 4/1979 | Larson . | |
| 4,319,379 | 3/1982 | Carrigan | 15/176 X |
| 4,415,288 | 11/1983 | Gordon et al. | 401/196 |

FOREIGN PATENT DOCUMENTS

| | | | |
|---|---|---|---|
| 356044 | 7/1922 | Fed. Rep. of Germany | 15/176 |
| 910732 | 2/1946 | France | 15/176 |
| 992302 | 5/1965 | United Kingdom | 15/176 |

*Primary Examiner*—Peter Feldman

*Attorney, Agent, or Firm*—Joseph G. Seeber

[57] ABSTRACT

A toothbrush assembly having a handle, a brush assembly releaseably interconnected with one end of the handle, and a massaging device connected with a second end of the handle. The brush assembly has a cylindrical base shaped to be received in a recess in the end of the handle and has an array of bristles arranged to provide a concave brushing surface. The massaging device includes a carrier having a container of liquid positioned in an internal cavity of the carrier. The container is positioned so as to be broken and dispense its contents when an end of a toothbrush is inserted into the carrier. A porous, absorbent material forms an outer surface of the device and absorbs the liquid for application to the gums of a user.

16 Claims, 11 Drawing Figures

TOOTHBRUSH ASSEMBLY COMBINING REPLACEABLE BRUSH ASSEMBLY WITH MASSAGING DEVICE

BACKGROUND OF THE INVENTION

Field of the Invention

This invention relates to toothbrushes. More particularly, the invention relates to a toothbrush having a generally circular brush at one end of a handle and a massaging device at the other end of the handle. Preferably, both the brush and the massaging device are replaceable.

SUMMARY OF THE INVENTION

The present invention provides an improved toothbrush assembly having a handle, a brush assembly releasably connected to one end of the handle, and a device for massaging gums connected to the other end of the handle.

Preferably, the brush assembly has a threaded cylindrical base that is received in a threaded recess formed in one end of the handle. The base carries an array of bristles, with bristles closest to the center of the base having axes extending substantially perpendicular to a plane of an upper surface of the base. The angles between the bristle axes and the plane of the upper surface decrease in a progressive manner radially outwardly from the center toward the periphery of the base. Also, the height of the bristles increases in a direction radially outwardly from the center of the base. Thus, the ends of the bristles form a concave contact surface that is complementary to the outer surface of a tooth.

In another embodiment, the concave contact surface is provided by bristles having axes perpendicular to the base. The height of the bristles increases progressively radially outwardly from the center of the base.

The massaging device has an internal cavity that is complementary shaped to the end of the handle so that there is a friction fit therebetween. The outer surface of the device is designed for massaging gums of a user. Preferably, the material that contacts the gums is porous so that an absorbed solution can be applied to the gums. In one embodiment, a container of liquid is disposed within the interior of the carrier in such a manner that the container is opened when the handle of a toothbrush is inserted into the device. Opening of the container results in dispensing of its contents onto the material of the carrier for application to the gums.

In another embodiment, the massaging device is provided as a cap that fits over the tail end of the brush and is shaped so as to frictionally grip the tail end. Strips of a compressed material, such as cellulose, that have been previously impregnated with small flavor beads of dehydrated or freeze dried liquid are attached to the cap by double stick adhesive. The strips are removed from the cap and disposed after use. The invention, and its objects and advantages, will become more apparent in the detailed description of the preferred embodiments hereinafter presented.

BRIEF DESCRIPTION OF THE DRAWINGS

In the detailed description of the preferred embodiments of the invention hereinafter presented, reference is made to the accompanying drawings, in which.

DESCRIPTION OF THE PREFERRED EMBODIMENTS

The present description will be directed in particular to elements forming part of, or cooperating more directly with, preferred embodiments of the present invention. Elements not specifically shown or described herein are understood to be selectable from those known in the art.

Figure 1:
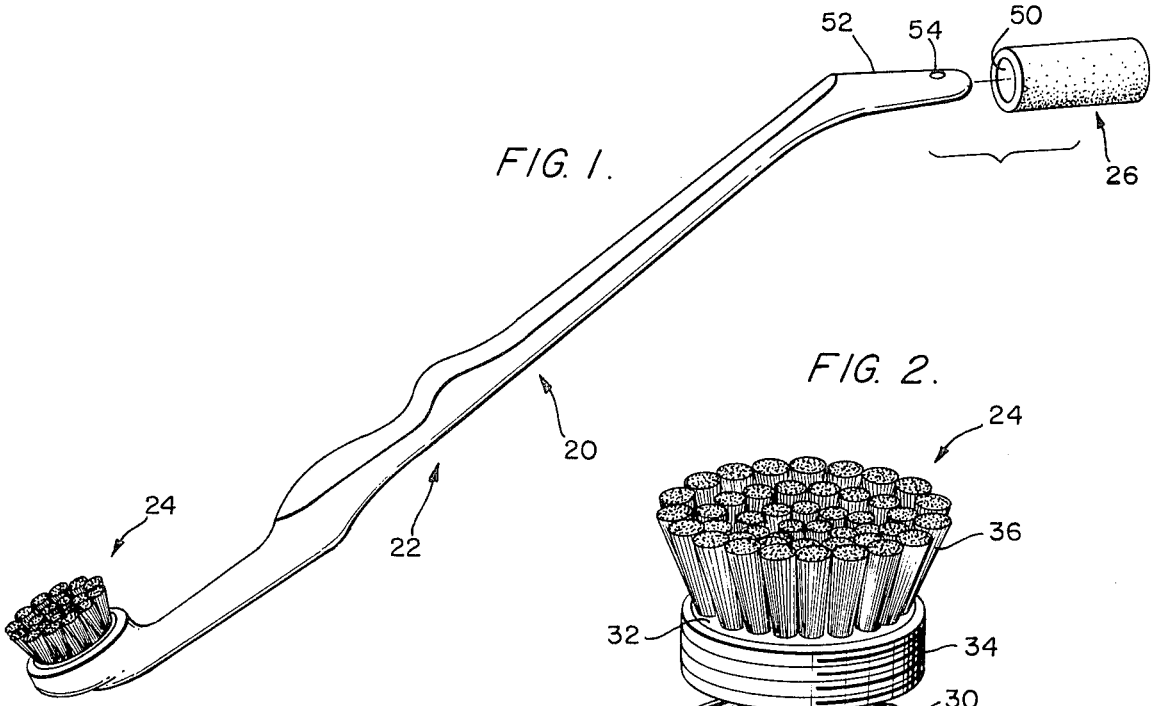
FIG. 1 is a schematic perspective view, partially exploded, of one embodiment of a toothbrush assembly according to the present invention.
Figure 2:
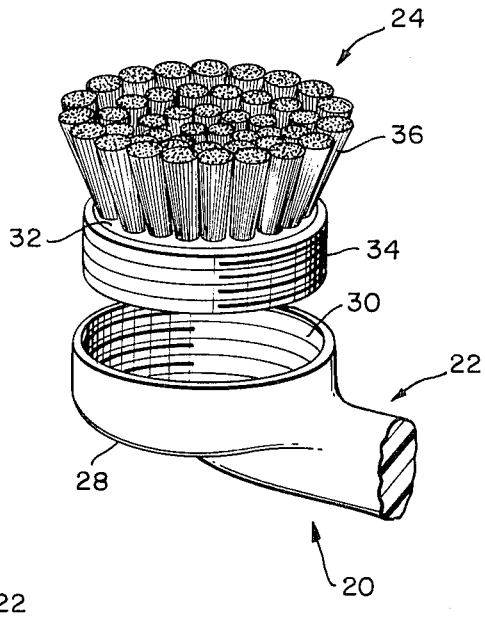
FIG. 2 is an exploded perspective of the bristle end of the toothbrush of FIG. 1.
Figure 3:
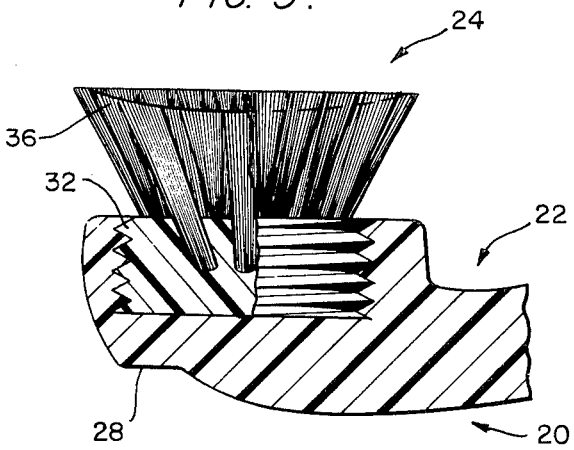
FIG. 3 is a schematic sectional view of the bristle end of the toothbrush assembly of FIG. 1.

Referring now to the drawings, and to FIGS. 1 to 3 in particular, one embodiment of a toothbrush assembly according to the present invention, generally designated 20, is illustrated. The toothbrush assembly 20 has a handle, generally designated 22, a brush assembly, generally designated 24, and a massaging device, generally designated 26.

As best illustrated in FIGS. 2 and 3, the bristle end 28 of the handle 22 has a threaded recess 30 formed therein. The brush assembly 24 has a cylindrical base 32 carrying threads 34 that are engageable with the threads in the recess 30. The two sets of threads form complementary fastening means for releaseably interconnecting the brush assembly 24 with the bristle end 28 of the handle 22.

The base 32 carries an array of bristles 36. Preferably, the bristles are arranged in a plurality of individual groups concentrically arrayed about the center of the base. The axes of the bristles closest to the center of the base are substantially perpendicular to the plane of the upper surface of the base. While it is preferred that the angles between the axes of the bristles and the plane progressively decrease in directions radially outwardly from the center of the base, as illustrated in FIG. 3, it is also possible to arrange all of the axes perpendicular to the base. The height of the bristles increases in directions from the center radially outwardly so that the array of bristles forms a generally concave surface for brushing teeth. Preferably, the heights of the bristles in the groups furtherest from the center of the base vary so as to provide a relatively uniform concave surface. Further, the shape of the surface is complementary to the shape of the side surface of a tooth. As best illustrated in FIG. 3, the base 32 is integrally formed from a plastic material. It should be readily apparent that the base also can be formed from metal.

Preferably, the bristles are polished and end rounded to ensure safe contact with the gingiva. The bristles, depending on their intended use, are soft, medium, or hard. Outer portions of the bristles form a concave pattern that matches the convex outer surface of a tooth. The thickness of the bristles is approximately 0.007 inches, with the outer rim of bristles having a height of approximately 0.4375 inches, with a gradual taper of the height of the bristles to the center to achieve the desired concavity. The number of bristles in each group of bristles is sufficient to have a "full feel" and should be at least twenty.

Figure 4:
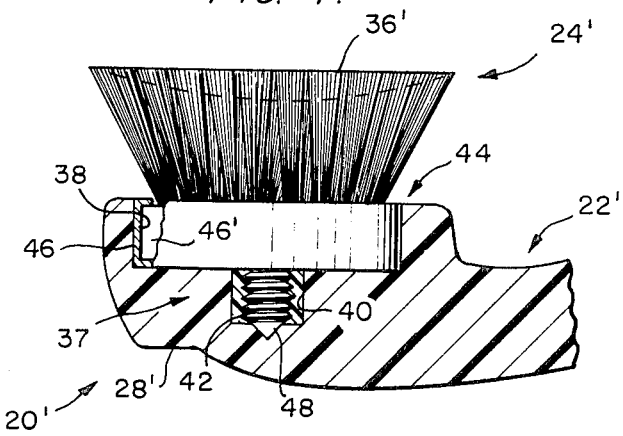
FIG. 4 is a partial sectional view of a modification of the bristle end of the toothbrush assembly of FIG. 1.

Referring now to FIG. 4, a modification of the toothbrush assembly provided by the present invention is illustrated. The same reference numerals, with primes attached, have been used to identify components similar to those previously described.

In FIG. 4, the handle 22' of the toothbrush assembly 20' has a bristle end 28' with a stepped recess, generally designated 37, formed therein. The recess 37 has an upper recess 38 and a lower recess 40. A threaded insert 42, preferably formed from metal or a rigid plastic, is positioned in the lower recess 40.

A brush assembly 24' has a composite base, generally designated 44. The base has a first component 46' that carries an array of bristles 36'. The base 44 is encompassed by a metal cylindrical sleeve 46 shaped to fit within the upper recess 38. A threaded shaft 48 extends downwardly from a lower surface of the sleeve 46. The shaft 48 cooperates with the insert 42 to provide complementary fastening means for releaseably interconnecting the brush assembly 24' with the bristle end 28' of the handle 22'.

Referring again to FIG. 1, one embodiment of a massaging device according to the present invention is illustrated. The device 26 is a cylindrical element formed of a soft porous material that defines an internal cavity 50. The shape of the cavity 50 is complementary to the shape of at least a portion of the second end 52 of the handle 22 so that the massaging device 26 mates with and is releaseably held on the end 52. When a user desires to massage his or her gums, the device 26 is positioned on the toothbrush so that it can be applied to the gums. The device 26 is preferably absorbent so that a treating solution can be absorbed by the device prior to massage of the gums. If massage only is desired, there is no need to first apply the treating solution. The handle 22 has a shaped opening 54 formed therein that is designed to releaseably hold an implement for removing material from between the teeth of a user, such as a stimulator. When it is desired to use the stimulator, the massaging device 26 is removed from the second end 52 and the stimulator is inserted through the opening 54.

Numerous different types of liquid can be applied by the massaging device provided by the present invention. Representative types of liquid include the following:

a concentrated mouthwash for its flavor and wake up the mouth feeling;

a solution that can release therapeutic agents such as oxygen as in Glyoxide or hydrogen peroxide;

a solution such as baking soda and salt;

a fluoride solution, either Phospho, Stannous or Sodium Fluoride; and a solution that contains a topical anesthetic that will numb sore gums and help to ease the pain of oral lesions.

Figure 5:
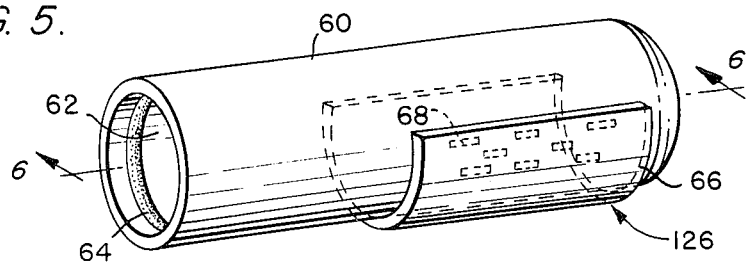
FIG. 5 is a perspective of one embodiment of a massaging device usable with the toothbrush assembly of FIG. 1.

Referring now to FIG. 5, a modification of the massaging device 26 is illustrated. The massaging device, which is generally designated 126, has a carrier 60 with an internal cavity 62 formed therein. A sealing member, such as an O-ring 64, is positioned at the inlet of the cavity 62. The configurations of the cavity 62 and the sealing member are determined by the shape of the second end 52 of the handle. The O-ring 64 is designed to releaseably hold the massaging device 126 on the handle and to provide a fluid-tight seal between the handle and the internal cavity 62. A material 66 for massaging gums is affixed to an exterior surface of the carrier 60. A plurality of openings, slits, or passageways 68 extend through the walls of the carrier 60 to establish fluid communication between the internal cavity 62 and the exterior surface of the carrier 60.

Figure 6:
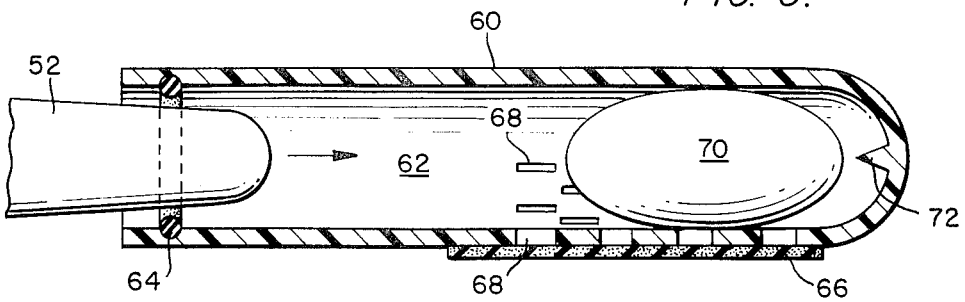
FIG. 6 is a view taken along line 6—6 of FIG. 5.

Referring now to FIG. 6, a container 70 of a treating liquid to be dispensed is positioned within the internal cavity 62. The side walls of the container 70 are sufficiently rigid so as to provide a friction fit between the container and the interior walls of the carrier 60. A protrusion 72 extends inwardly from the wall of the carrier 60. When the end of a toothbrush handle is inserted into the internal cavity 62, the end pushes the container 70 onto the projection 72 so that the container is punctured and its contents are dispensed through the slits 68. The O-ring 64 prevents leakage of the liquid around the handle. Preferably, the material 66 is porous and absorbs the liquid for subsequent application to the gums of a user.

In one embodiment of the invention, the material 66 is cellulose that is compressed prior to absorbing the liquid and is expanded by absorption of the liquid. Other types of usable materials include cotton gauze, lamb's wool, synthetic lamb's wool, and foam rubber. The selected material should be soft and pliable material that is very mildly abrasive to stimulate and massage gums without causing excessive irritation.

Figure 7:
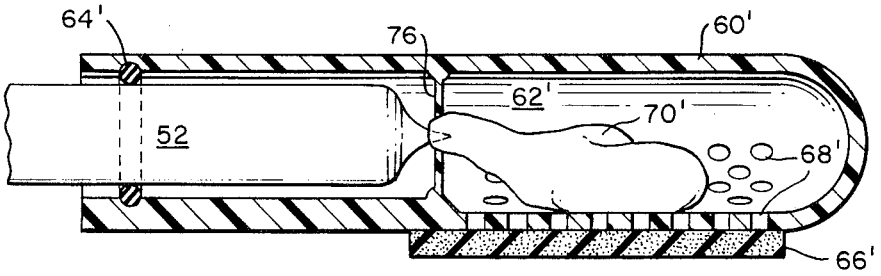
FIG. 7 is a view similar to FIG. 6 of another embodiment of a massaging device according to the present invention.

Referring now to FIG. 7, a modification of the embodiment of FIG. 6 is illustrated. With this embodiment, the same reference numerals, with primes attached, are used to identify components similar to those previously described.

The carrier 60' illustrated in FIG. 7 has an internal cavity 62' having an O-ring seal 64' positioned to frictionally engage the end of a toothbrush inserted into the cavity so as to provide a liquid-tight seal. A porous absorbent material 66' is positioned on an outer surface of the carrier 60'. Openings 68' are formed in the carrier for passage of fluid from the internal cavity 62' to the material 66'. Suitable means, such as a spider 76, protrudes inwardly from side walls of the carrier 60' to hold a container 70' in a desired position within the internal cavity. When the end 52 of a toothbrush is inserted into the internal cavity 62', the spider 76 prevents movement of the container 70' so that the container is pierced or ruptured by the end of the toothbrush. FIG. 7 illustrates the relationship between the handle and the carrier after the contents of the container have been dispensed. It should be noted that the material 66' has been expanded by absorption of the liquid.

Figure 8:
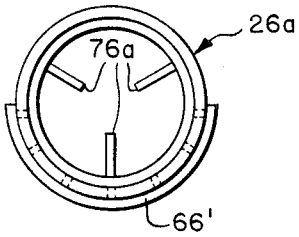
FIGS. 8 to 10 are end views illustrating different configurations of massaging devices provided by the present invention.
Figure 9:
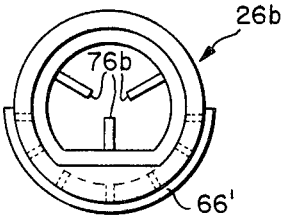
Figure 10:
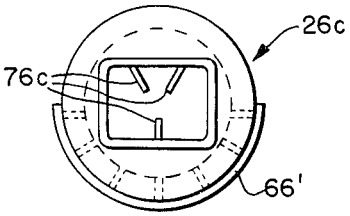

Referring now to FIGS. 8 to 10, various configurations of the internal cavity of the carrier are illustrated. FIG. 8 illustrates a massaging device **26*a* in which the internal cavity has a generally circular cross section. A spider 76*a* is positioned within an internal cavity of the carrier for holding a container of liquid to be dispensed. FIG. 9 illustrates a massaging device 26*b* having an internal cavity with an arcuate shaped upper portion and a flat lower portion. A spider 76b is positioned within the internal cavity for holding a container of fluid to be dispensed. FIG. 10 illustrates a massaging device 26c in which the internal cavity of the carrier has a generally rectangular cross section. A spider 76c is positioned within the cavity for holding a container in a desired position. It should be appreciated that the cross section of the internal cavity is determined by the external configuration of the toothbrush handle to be inserted into the cavity. The illustrated cross sections are intended merely as representative examples. It should further be appreciated that the container of liquid to be dispensed can be positioned in the embodiments of FIGS. 8 to 10 in the same manner as that illustrated in the embodiment of FIG. 6**.

Figure 11:
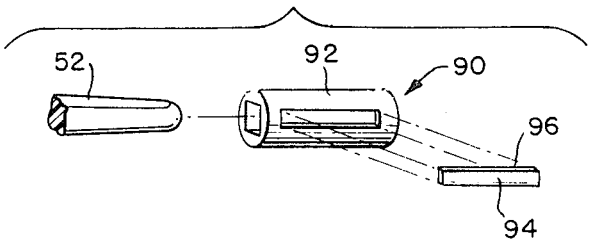
FIG. 11 is a perspective, partially exploded, of another embodiment of a massaging device usable with the toothbrush assembly of FIG. 1.

Referring now to FIG. 11, another embodiment of a massaging device according to the present invention is illustrated. The massaging device, which is generally designated 90, is similar to the previously described device 26. The device 90 includes a carrier 92 that has an internal cavity shaped to frictionally engage the tail or second end 52 of a toothbrush handle. The external periphery of the cap 92 is shaped to provide a suitable contour for a massaging apparatus. A plurality of individual strips 94 are designed to be releasably connected to the carrier 92. In one embodiment of the invention, the strips are formed of compressed cellulose that has been impregnated with small flavor beads of dehydrated or freeze dried liquid. The strips are disposable and include an adhesive layer 96 for releasably connecting the strips to the carrier 92. It should be appreciated that the carrier 92 is not required if the handle of the toothbrush is appropriately shaped.

Previously, specific embodiments of the present invention have been described. It should be appreciated, however, that these embodiments have been described for the purposes of illustration only, without any intention of limiting the scope of the present invention. Rather, it is the intention that the present invention be limited only by the appended claims.

What is claimed is:

1. A toothbrush assembly comprising:

a handle having first and second ends;

a stepped recess formed in the first end of said handle, said stepped recess comprising an upper recess disposed at a surface of said handle and having a first width, and a lower recess disposed beneath and adjoining said upper recess and having a second width less than said first width;

a brush assembly having a base shaped to be received in said upper recess and an array of bristles protruding from the base;

complementary fastening means comprising a first component provided in said lower recess and a second component carried by said base for interconnecting said brush assembly with said first component in said lower recess; and means for massaging gums comprising a carrier having an internal cavity shaped to mate with the second end of the handle, and a material for massaging gums supported by the carrier, the means for massaging gums being removable from the handle;

wherein said carrier has walls with a plurality of openings formed therein, and wherein said means for massaging gums further comprises a container of liquid disposed within said internal cavity of said carrier so as to disperse liquid upon insertion of the second end of the handle into the internal cavity, said material for massaging gums covering said openings and being porous so as to absorb the dispensed liquid for application to gums being massaged.

2. A toothbrush assembly according to claim 1, wherein said stepped recess is cylindrically shaped, and said first component of said complementary fastening means comprises a first series of threads provided in said lower recess, and wherein said second component of said complementary fastening means comprises a second series of threads provided on said base, said second series of threads being engageable with said first series of threads to interconnect said brush assembly with said handle.

3. A toothbrush assembly according any one of claims 1 or 2, wherein said array of bristles comprises a plurality of groups of bristles, bristles in groups closest to the center of the base having axes extending substantially perpendicular to a plane of an upper surface of the base, the angles between the bristle axes and the plane of the upper surface decreasing in a progressive manner radially outwardly from the center towards the periphery of the base.

4. A toothbrush assembly according to claim 3, wherein bristles closest to the center of the base are shorter than bristles furtherest from the center so that the array of bristles has a concave surface for contacting the surface of a tooth.

5. A toothbrush assembly according to claim 1, wherein said array of bristles comprises a plurality of groups of bristles, bristles closest to the center of the base being shorter and the heights of the bristles progressively increasing from the center of the base radially outwardly.

6. A toothbrush assembly according to claim 1, wherein said material for massaging gums is cellulose, the cellulose being compressed prior to absorption of the liquid and being expanded by absorption of the liquid.

7. A toothbrush assembly according to claim 2, wherein said first series of threads comprises a threaded insert disposed in said lower recess.

8. A toothbrush assembly according to claim 7, wherein said threaded insert is formed of rigid plastic.

9. A toothbrush assembly according to claim 7, wherein said threaded insert is formed of metal.

10. A toothbrush assembly according to claim 1, wherein said upper recess and said lower recess comprise respective coaxially arranged bores formed in the first end of said handle.

11. A toothbrush assembly according to claim 10, wherein said bores are cylindrical in shape.

12. A toothbrush assembly comprising:

a handle having first and second ends;

a cylindrical shaped recess formed in the first end of said handle;

a brush assembly having a base shaped to be received in said recess and an array of bristles protruding from the base;

complementary fastening means having a first component provided in said recess and a second component carried by said base for interconnecting said brush assembly with said recess; and massaging means for massaging gums comprising a carrier having an internal cavity shaped to mate with the second end of the handle and a material for massaging gums supported by the carrier, the massaging means being removable from the handle; and wherein said carrier has walls with a plurality of openings formed therein, and said massaging means further comprises a container of liquid disposed within said internal cavity of said carrier and so positioned as to disperse liquid upon insertion of the second end of the handle into the internal cavity, said massaging means covering said openings and being porous so as to absorb the dispensed liquid for application to the gums being massaged.

13. A toothbrush assembly according to claim 12, wherein said material for massaging gums is cellulose, the cellulose being compressed prior to absorption of the liquid and being expanded by absorption of the liquid.

14. A toothbrush assembly according to claim 12, further comprising projection means disposed on one of said walls and projecting into said internal cavity for puncturing said container of liquid when said second end of the handle is inserted into the internal cavity.

15. A toothbrush assembly according to claim 12, further comprising O-ring means positioned in said internal cavity for frictionally engaging the second end of the handle when it is inserted into the internal cavity.

16. A toothbrush assembly according to claim 12, further comprising spider means positioned in said internal cavity and protruding inwardly from the walls for holding the container of liquid and for preventing movement of the container of liquid when the second end of the handle is inserted into the internal cavity.

* * * * *